US005552652A

United States Patent [19]

Shimoyama et al.

[11] Patent Number: 5,552,652

[45] Date of Patent: Sep. 3, 1996

[54] COMMUTATOR WITH IMPROVED CONNECTION BETWEEN CARBON AND METAL SEGMENTS

[75] Inventors: Shuji Shimoyama, Kiryu; Iwao Yanagizawa, Suzuka, both of Japan

[73] Assignees: Mitsuba Electric Mfg. Co., Ltd., Kiryu; Kunimitsu Carbon Industry Co., Ltd., Suzuka, both of Japan

[21] Appl. No.: 352,182

[22] Filed: Dec. 1, 1994

[30] Foreign Application Priority Data

Dec. 22, 1993 [JP] Japan ..... 5-345519

[51] Int. Cl.[6] ..... H01R 43/08

[52] U.S. Cl. ..... 310/237; 310/233

[58] Field of Search ..... 310/237, 234, 310/235, 42, 233; 29/597

[56] References Cited

U.S. PATENT DOCUMENTS

| | | | |
|---|---|---|---|
| 1,537,692 | 5/1925 | Prouty | 310/237 |
| 1,901,955 | 3/1933 | Giaimo | 29/597 |
| 2,421,845 | 6/1947 | Moeller | 310/237 |
| 3,538,365 | 11/1970 | Reisnecker | 310/237 |
| 5,157,299 | 10/1992 | Gerlach | 310/237 |
| 5,175,463 | 12/1992 | Farago et al. | 310/237 |
| 5,400,496 | 3/1995 | Kemmner | 29/597 |
| 5,442,849 | 8/1995 | Strobl | 310/237 |

FOREIGN PATENT DOCUMENTS 2-53260 4/1990 Japan .

*Primary Examiner*—Thomas M. Dougherty
*Attorney, Agent, or Firm*—Wenderoth, Lind & Ponack

[57] ABSTRACT

A flat commutator includes a circular arrangement of sectorial carbon segments made of conductive carbon providing commutating surface of the commutator, metallic segments attached to respective of the carbon segments, and a hub body of synthetic resin. The metallic segments have fixing members encroaching into inner and outer peripheral surfaces of the carbon segments, thereby fixing the carbon segments to the metallic segments. The hub body encloses at least fixed portions of the inner and outer peripheral surfaces of the carbon segments that engage with the fixing members of the metallic segments.

8 Claims, 2 Drawing Sheets

COMMUTATOR WITH IMPROVED CONNECTION BETWEEN CARBON AND METAL SEGMENTS

BACKGROUND OF THE INVENTION

1. Field of the Invention

The present invention relates to a flat commutator including conductive carbon elements and more particularly to such a flat commutator for use in a motor for a fuel pump utilized in a fuel tank of an automobile or the like.

2. Description of the Prior Art

In general, fuel pumps have been used in automotive applications to supply liquid fuel contained in a fuel tank to the engine, and such fuel pumps are arranged in the fuel tanks.

On the other hand, due to a rising cost of normal fuel and an increased consideration for environmental contamination, there has been noticed a new fuel containing an oxygen compound, such as methyl alcohol and ethyl alcohol, etc. Therefore, when the fuel pump is used in the fuel tank containing such a fuel and if such a fuel pump includes a motor including a metallic commutator, it will corrode by the above mentioned alcohol contained in the fuel, so that the life of the motor is shortened. Under such a circumstance, a commutator which includes conductive carbon elements has been developed.

Such prior art commutators including the above mentioned conductive carbon elements are disclosed in U.S. Pat. Nos. 5,157,299 and 5,175,463 and in Japanese Utility Model Publication No. 2-53260.

Among these documents, U.S. Pat. No. 5,157,299 discloses a structure wherein carbon segments are connected to a metallic segment support through an adhesive layer of solder. U.S. Pat. No. 5,175,463 discloses a structure wherein segments are attached on a base through the intermediary of a first conductive layer of material such as nickel, copper, etc. and a second conductive layer of material such as gold, silver, etc. JUMP No. 2-53260 discloses a structure wherein a hub body is mechanically and electrically connected to carbon segments partially shaped to be of particular configuration.

In U.S. Pat. Nos. 5,157,299 and 5,175,463, however, there is no consideration of the strength of the commutator against a stress caused therein during its rotation, although suitable conductivity can be obtained in either case.

In addition, the commutator disclosed in JUMP No. 2-53260 is not always shaped to have a simple configuration, so that manufacture thereof is not easy.

SUMMARY OF THE INVENTION

It is therefore an object of the present invention to provide a commutator of simple structure which does not cause the life thereof to be shortened if a fuel containing an oxygen is used.

This object of the invention is accomplished by provision of a flat commutator comprising a plurality of carbon segments each of which has a sectorial configuration, the carbon segments being made of conductive carbon material and defining a commutating surface of the commutator. The carbon segments are attached to respective metallic segments and are arranged circularly. Each metallic segment has fixing members that encroach onto inner and outer peripheral surfaces of the respective carbon segment, thereby fixing the carbon segment on the metallic segment.

A hub body of synthetic resin encloses at least fixed portions of the inner and outer peripheral surfaces of the carbon segments that engage with the fixing members of the metallic segment.

With this arrangement, since the carbon segments are engaged with the metallic segments through the fixing members which encroach upon the inner and outer peripheral surfaces of the carbon segments, the carbon segments can be fixed to the metallic segments rigidly and the appropriate conductivity therebetween can be attained. In addition, since the fixed portions of the carbon segments which are fixed by the fixing members of the metallic segment are enclosed in the hub body of synthetic resin, the fixed portions are not eroded even under conditions of use of fuel containing oxygen, and thus stable conductivity can be obtained. Further, if enclosing is achieved by use of a synthetic resin, the carbon segments will be supported more rigidly by the metallic segments.

Preferably, in the above commutator, the fixed portions comprises recesses formed in the inner and outer peripheral surfaces of the carbon segments. In such a case, due to provision of the recesses, the positioning of the fixing members on the carbon segments can be ensured so that a deviation thereof relative to the metallic segments in the circumferential direction of the carbon segments can be prevented.

In the present invention, preferably the metallic segment has a plurality of engagement members formed around the inner fixing members. In such case, provision of the engagement pieces ensures integration the metallic segment with the hub body.

Further, in the present invention each metallic segment is provided on an outer periphery thereof with a connection terminal which projects radially outwardly of the metallic segment.

The commutator according to the present invention is manufactured by a method comprising providing a base member having engagement portions formed on inner and outer peripheral surfaces thereof, the base member being made of conductive carbon in the form of a circular plate body, and providing a metallic plate member having a bottom face substantially identical to a bottom face of the base member, the metallic plate member further including connection terminals projecting from an outer periphery thereof and fixing members extending upwardly from inner and outer peripheries thereof. The base member is press-fit to the metallic plate member so that the fixing members encroach into the engagement portions of the base member. The engagement portions of the base member which are supported by the metallic plate member are enclosed with synthetic resin, thereby forming a synthetic resin hub body. Slits are formed in the base member and the metallic plate member to separate them into a plurality of segments so that each of the segments contains at least one pair of the engagement portions on the inner and outer peripheries of the base member, respectively.

By the operations of press-fitting the base member to the metallic plate member so that the fixing members encroach into the respective engagement portions of the base member, sequently enclosing the engagement portions of the base member with the synthetic resin, and then forming slits in the base member and the metallic plate member, the commutator can be manufactured easily. Furthermore, since, at the engagement portions formed on inner and outer peripheral surfaces of the base member, the carbon segments and the metallic segments constituting the segments obtained by provision of the slits are fixed to each other in a stable and rigid condition, the segments can be supported stably in opposition to centrifugal force acting thereon when using the commutator. Thus, it is possible to maintain stable operation for a long period of time.

Other objects and features of the present invention will become more fully apparent from the following description and appended claims taken in conjunction with the accompanying drawings.

DESCRIPTION OF THE PREFERRED EMBODIMENT

An embodiment of the present invention is now described with reference to the drawings.

Figure 1:
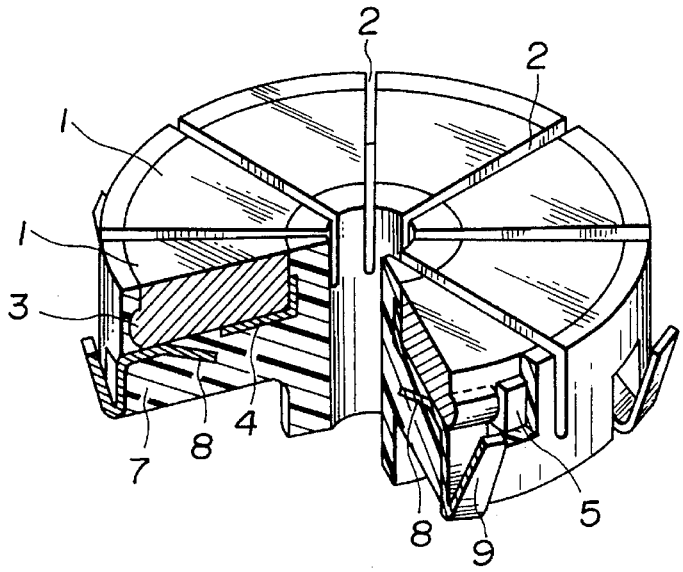
FIG. 1 is a perspective view of a commutator of the present invention, in which a part thereof is cut away.
Figure 2:
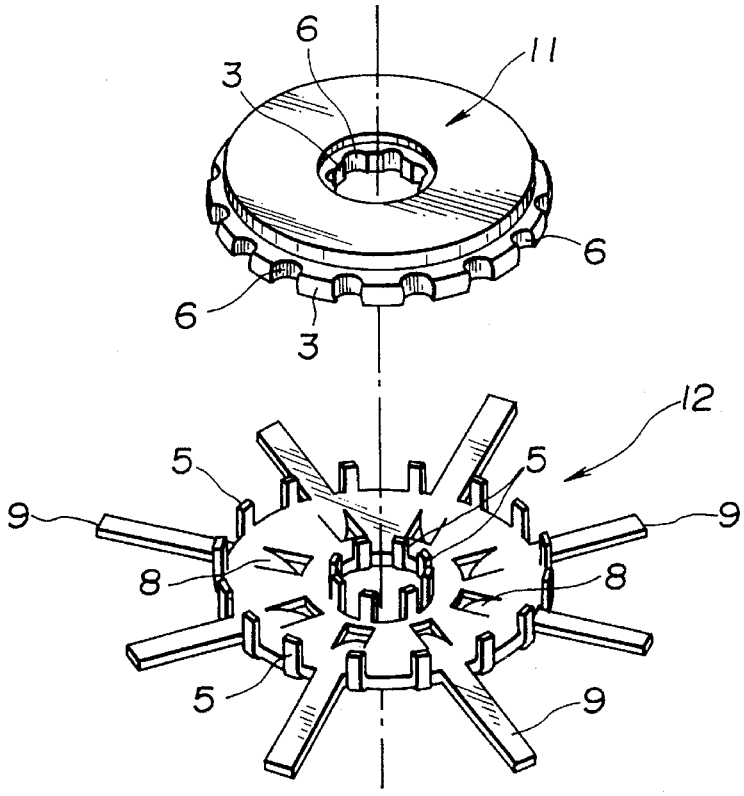
FIG. 2 is an exploded perspective view of a base member of a conductive carbon element and a metallic plate member, as constituents of carbon segments and metallic segments, and which are used for production of the commutator of FIG. 1.

FIG. 1 is a perspective view of a commutator of the present invention, in which a part thereof is cut away to clarify an inside structure of the commutator. FIG. 2 is a perspective view of a base member 11 of a conductive carbon element and a metallic plate member 12 in a disassembled state, as constituents of carbon segments and metallic segments of the commutator of the invention.

In an assembled state shown in FIG. 1, carbon segments 1 made of a conductive carbon material, each of which has a sectorial top face, are arranged in a circular manner spaced by respective slits 2 so as not to be in contact with each other. Further, each of the carbon segments 1 is provided on inner and outer peripheries thereof with projecting rims 3 which are located in the vicinity of lower ends of the respective peripheries.

Provided under each of the carbon segments 1 is a respective metallic segment 4 which is made of a suitable material such as copper or the like. The segment 4 is provided at inner and outer peripheral ends thereof with fixing members 5 which extend upwardly therefrom. The fixing members 5 encroach or fit into recesses 6 formed in the respective projecting rims 3, so that it is possible to ensure not only electrical conductivity between each carbon segment 1 and the respective metallic segment 4, but also fixing of the carbon segments 1 on the respective segments 4 in the circumferential, diametrical and axial directions thereof.

Figure 4:
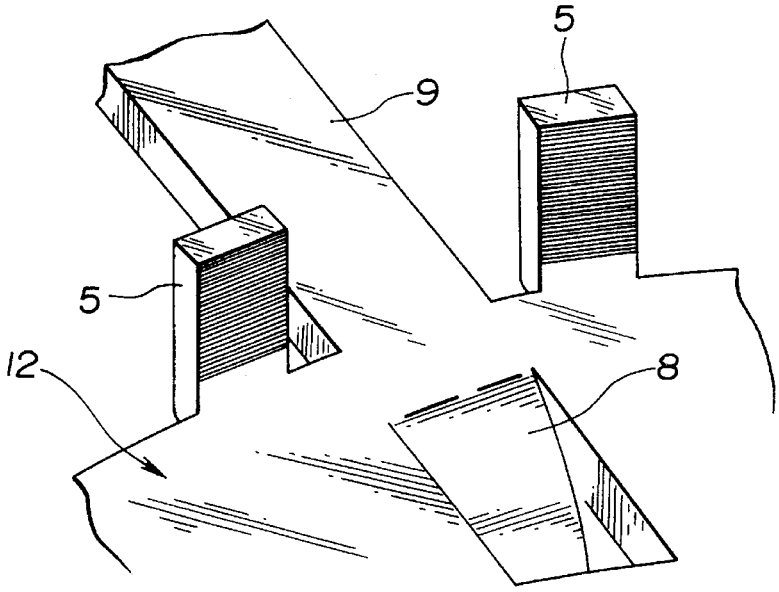
FIG. 4 is an enlarged perspective view showing fixing surfaces of fixing members of the plate member for fixing to the base member.

FIG. 4 shows fixing faces of outer fixing members 5 of plate member 12 to form one metallic segment 4. In the illustrated embodiment, a large number of irregularities are formed on the fixing face of each fixing member 5 so as to increase the area of engagement thereof with the respective carbon segment 1.

Furthermore, as shown in FIG. 1, the carbon segments 1 and the metallic segment 4 are covered inside of respective inner peripheral ends thereof, outside of respective outer peripheral ends thereof and beneath the segments 4 with a non-conductive hub body 7 which is made of synthetic resin. The metallic plate member 12 includes a plurality of engagement members 8 in order to ensure an integration thereof with the hub body 7 and further includes a plurality of connection terminals 9 formed on an outer periphery thereof.

The commutator of the invention is produced as follows.

At first, as shown in FIG. 2, base member 11 of conductive carbon material is formed so as to be a circular plate member having projecting rims 3 integrally formed on inner and outer circumferential surfaces and in vicinities of respective lower edges thereof. Next, to provide for engagement with the fixing members 5 of the metallic plate member 12, recesses 6 are regularly formed on the respective rims 3 by cutting away material of the rims 3 at intervals by suitable cutting means. Alternatively, the recesses 6 and the rims 3 may be simultaneously formed by pressing, at the stage of manufacture of the circular base member 11. Further, the recesses 6 need not always be formed so as to have smooth surfaces in comparison with other surfaces of the base member 11. That is, if recesses 6 are formed with uneven surfaces, areas of engagement of the base member 11 with the fixing members 5 would be increased, thereby allowing conductivity and mechanical integration between the base member 11 and metallic plate member 12 to be increased. On the other hand, by a stamping operation or the like, metallic plate member 12 to form the metallic segments 4 is formed as to be of a circular shape and to have the fixing members 5 extending from inner and outer peripheries thereof at locations corresponding to respective recesses 6. At such stamping stage, the above-mentioned engagement members 8 are formed around the inner fixing members 5, and the connection terminals 9 are formed to project radially outwardly from the outer periphery of the member 12.

Figure 3:
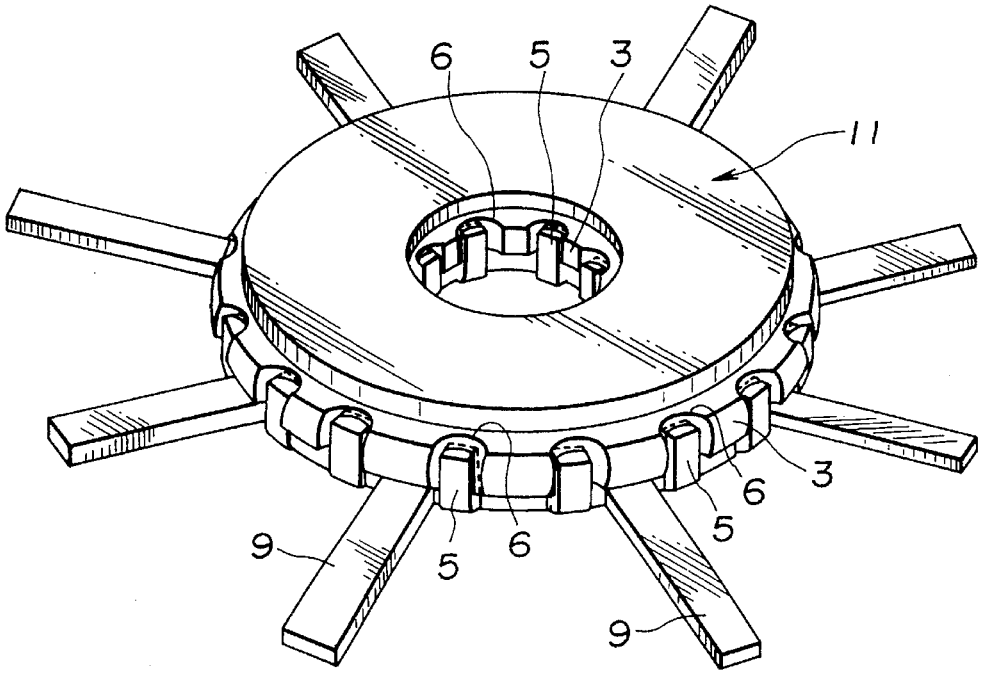
FIG. 3 is a perspective view showing a condition wherein the plate member is secured to the base member during production of the commutator of the present invention.

Next, after positioning the respective recesses 6 of the base member 11 in alignment with the respective fixing members 5 of the plate member 12, the base member 11 is engaged with the plate member 12 by suitable means, such as press-fitting, so that an assembly as shown in FIG. 3 is formed.

Thereafter, the non-conductive hub body 7 made of a suitable material such as synthetic resin or the like is formed integrally with such assembly so as to form a central portion into which an output shaft of a motor (not shown) can be inserted at the inside of the assembly and to extend around the outside of the assembly and under the metallic plate member 12. In this way, the integration of the base member 11 with the plate member 12 can be improved, whereby conductivity therebetween through the fixing members 5 further is improved. In addition, since also the engagement members 8 of the plate member 12 are surrounded by and embedded in the synthetic resin when molding the hub body 7, the plate member 12 is fixed securely to the hub body 7.

Next, the slits 2 are formed in the thus formed commutator body to extend from a top face of the base member 11 downwardly to a level somewhat below the underside of the plate member 12. The commutator thus is completed.

When the connection terminals 9 or bent, e.g. as shown in FIG. 1, since all contact between the carbon segments 1 and the metallic segments 4 are sealed in the synthetic resin, stable conductivity can be maintained over a long period of use. Furthermore, due to press-fitting of the fixing members 5, fixing attachment between the carbon segments I to the metallic segments 4 can be executed easily and maintained stably.

According to the invention, the fixing members 5 have only to serve to fix the carbon segments 1 to the metallic segments 4 under conditions that each carbon segment 1 is clamped between the respective fixing members 5. It will be understood by those skilled in the art that the present invention is not limited to the aforementioned embodiment in terms of configuration, number, and position of the metallic segments, etc. Further, irregularities on back faces of the fixing members 5 other than those illustrated may be employed in terms of configuration, position and size, without departing from the object of increasing the area of engagement of the members 5 with the carbon segments 1. Although the projecting rims 3 are formed on both inner and outer peripheries of the carbon segments 1 in the shape of the bands, the configuration thereof is not limited to such illustrated embodiment.

Finally, it will be understood by those skilled in the art that the invention is not limited to the forgoing description of the embodiment of the disclosed commutator, and that various changes and modifications may be made thereto without departing from the spirit and scope of the invention.

What is claimed is:

1. A flat commutator comprising:

a plurality of carbon segments formed of conductive carbon material, said carbon segments being arranged in a circular arrangement and defining a commutating surface of said commutator, and each said carbon segment having a sectorial configuration including an inner peripheral surface and an outer peripheral surface;

a plurality of metallic segments, each said metallic segment having fixing members encroaching into fixed portions of said inner and outer peripheral surfaces of a respective said carbon segment and thereby fixing said each metallic segment to said respective carbon segment; and a hub body formed of synthetic resin and enclosing at least said fixed portions of said inner and outer peripheral surfaces of all said carbon segments.

2. A flat commutator as claimed in claim 1, wherein said fixed portions comprise recesses formed in said inner and outer peripheral surfaces.

3. A flat commutator as claimed in claim 2, wherein said fixing members of each said metallic segment extend from inner and outer peripheral portions thereof and fit in respective said recesses in said inner and outer peripheral surfaces of said respective carbon segment.

4. A flat commutator as claimed in claim 1, wherein each said metallic segment has an engagement member embedded in said hub body.

5. A flat commutator as claimed in claim 4, wherein said engagement member is positioned outwardly of an inner said fixing member of said metallic segment.

6. A flat commutator as claimed in claim 1, wherein each said metallic segment has a radially outwardly projecting connection terminal.

7. A flat commutator as claimed in claim 6, wherein said connection terminal extends outwardly through said hub body.

8. A flat commutator as claimed in claim 1, wherein said hub body includes an inner portion covering inner peripheral ends of all of said carbon segments and said metallic segments, an outer portion covering outer peripheral ends of all of said carbon segments and said metallic segments, and a lower portion joining said inner and outer portions and covering respective sides of all of said metallic segments opposite said respective carbon segments.

* * * * *